US006124073A

United States Patent [19]

Rompuy et al.

[11] Patent Number: 6,124,073

[45] Date of Patent: Sep. 26, 2000

[54] HEAT-SENSITIVE IMAGING ELEMENT AND A METHOD FOR PRODUCING LITHOGRAPHIC PLATES THEREWITH

[75] Inventors: Ludo Van Rompuy, Mortsel; Luc Leenders, Herentals, both of Belgium

[73] Assignee: Agfa-Gevaert, N.V., Mortsel, Belgium

[21] Appl. No.: 09/200,921

[22] Filed: Nov. 30, 1998

Related U.S. Application Data

[60] Provisional application No. 60/073,746, Feb. 5, 1998.

[30] Foreign Application Priority Data

Dec. 9, 1997 [EP] European Pat. Off. ..... 97203856

[51] Int. Cl.[7] ..... G03C 1/492

[52] U.S. Cl. ..... 430/270.1; 430/303

[58] Field of Search ..... 430/270.1, 302, 430/303

[56] References Cited

U.S. PATENT DOCUMENTS

| | | | |
|---|---|---|---|
| 3,682,633 | 8/1972 | Curtin . | |
| 3,775,115 | 11/1973 | Sorkin et al. | 96/33 |
| 3,901,700 | 8/1975 | Yoerger et al. | 96/1 R |
| 4,087,584 | 5/1978 | Taniguchi et al. | 428/422 |
| 5,378,580 | 1/1995 | Leenders | 430/303 |
| 5,713,287 | 2/1998 | Gelbart . | |
| 5,968,709 | 10/1999 | Verschueren et al. | 430/272.1 |
| 6,022,668 | 2/2000 | Burberry et al. | 430/302 |
| 6,040,115 | 3/2000 | Bailey et al. | 430/303 |
| 6,051,365 | 4/2000 | Kellett | 430/278.1 |

FOREIGN PATENT DOCUMENTS 103 977 2/1974 German Dem. Rep. .

OTHER PUBLICATIONS

R. L. Scank: "Photoinduced Ink Receptive Images In Silicone Systems For Waterless Lithography Applications", Xerox Disclosure Journal, vol. 1, No. 2, Feb. 1976, XP002067523.

*Primary Examiner*—Janet Baxter
*Assistant Examiner*—Barbara Gilmore
*Attorney, Agent, or Firm*—Breiner & Breiner

[57] ABSTRACT

According to the present invention there is provided a heat sensitive recording material comprising a support and thereon a surface layer comprising an ink abhesive binder, characterized in that said binder is capable of being image-wise converted to an ink acceptive binder by exposure to heat or actinic irradiation.

9 Claims, No Drawings

HEAT-SENSITIVE IMAGING ELEMENT AND A METHOD FOR PRODUCING LITHOGRAPHIC PLATES THEREWITH

The application claims the benefit of U.S. Provisional Application Ser. No. 60/073,746 filed Feb. 5, 1998.

DESCRIPTION

1. Field of the Invention

The present invention relates to a heat sensitive recording material for making a lithographic printing plate for use in lithographic printing without dampening. The present invention further relates to a method for imaging said heat sensitive recording material by means of a laser.

2. Background of the Invention

Lithographic printing is the process of printing from specially prepared surfaces, some areas of which are capable of accepting ink (oleophilic areas) whereas other areas will not accept ink (oleophobic areas). The oleophilic areas form the printing areas while the oleophobic areas form the background areas.

Two basic types of lithographic printing plates are known. According to a first type, so called wet offset printing plates, both water or an aqueous dampening liquid and ink are applied to the plate surface that contains hydrophilic and hydrophobic areas. The hydrophilic areas will be soaked with water or the dampening liquid and are thereby rendered oleophobic while the hydrophobic areas will accept the ink. A second type of lithographic offset printing plates operates without the use of a dampening liquid and are called driographic printing plates. This type of printing plates comprises highly ink repellant areas and oleophilic areas. Generally the highly ink repellant areas consist of a silicon layer.

Driographic printing plates can be prepared using a photographic material that is made image-wise receptive or repellant to ink upon photo-exposure of the photographic material. However heat sensitive recording materials, which can be made image-wise receptive or repellant to ink upon image-wise exposure to heat and/or subsequent development are also known for preparing driographic printing plates.

For example in DE-A-2512038 there is disclosed a heat sensitive recording material that comprises on a support carrying or having an oleophilic surface (i) a heat sensitive recording layer containing a self oxidizing binder e.g. nitrocellulose and a substance that is capable of converting radiation into heat e.g. carbon black and (ii) a non-hardened silicon layer as a surface layer. The disclosed heat sensitive recording material is image-wise exposed using a laser and is subsequently developed using a developing liquid that is capable of removing the silicon layer in the exposed areas. Subsequent to this development the silicon surface layer is cured. Due to the use of naphta as a developing liquid the process is ecologically disadvantageous. Further since the surface layer is not hardened the heat sensitive recording material may be easily damaged during handling.

FR-A-1.473.751 discloses a heat sensitive recording material comprising a substrate having an oleophilic surface, a layer containing nitrocellulose and carbon black and a silicon layer. After image-wise exposure using a laser the imaged areas are said to be rendered oleophilic. The silicon layer decomposed on the exposed areas is removed on press. Ink acceptance of the obtained plates is poor and the printing properties such as printing endurance and resolution of the copies is rather poor.

Research Disclosure 19201 of April 1980 discloses a heat sensitive recording material comprising a polyester film support provided with a bismuth layer as a heat sensitive recording layer and a silicon layer on top thereof. The disclosed heat sensitive recording material is imaged using an Argon laser and developed using hexane.

EP-A-573091 discloses a method for making a lithographic printing plate requiring a heat sensitive recording material comprising on a support having an oleophilic surface (i) a recording layer having a thickness of not more than 3 $\mu$m and containing a substance capable of converting the laser beam radiation into heat and (ii) a cured oleophobic surface layer and wherein said recording layer and oleophobic surface layer may be the same layer. The exposed material is processed by a rub-off step.

WO-97/00175 describes an infrared ablatable driographic printing plate including a substrate, an IR absorbing layer comprising substantially a first water based emulsion and a top IR ablatable layer comprising substantially a second water based emulsion.

WO-97/00735 describes a laser imageable lithographic printing plate comprising a substrate, a photosensitive coating on the substrate and a water soluble laser ablatable top coating containing dyes or polymers that absorb infrared, ultraviolet and visible light.

WO-97/006956 describes a waterless printing plate comprising a support, an optional metal or metaloxide layer, an IR absorbing ablatable layer of a polymer with a degradation temperature between 130 and 360° C. and an absorbing dye, and an overcoat of a polymer soluble in fluorinated solvents with a thickness of less than 2 $\mu$m.

EP-A-764522 describes an environmentally friendly waterless printing plate comprising aluminum or PET-support with a first IR-laser light absorbing ablatable polymer layer, optionally with a contrasting layer and a silicone top layer each coated from a solventless UV-hardenable mixture with additional functionality on polymers to interbond the layers upon heat treatment.

Xerox Disclosure Journal, vol 1, no 2, February 76 discloses a suitable master substrate, coated with a layer comprising an abhesive silicone polymer or a silicone polymer which can be cured to an abhesive condition, a silicone fluid having reactive pendant hydrogen atoms, and a sensitizer for the silicone fluid. The coating is then subjected to activating electromagnetic radiation sufficient to activate the sensitizer and render the coating ink-accepting in the image areas, and the background areas cured to an elastomeric condition.

FR-A-1,560,414 discloses a lithographic printing plate, capable of being provided with oleophilic image areas and ink accepting areas in dry state, and capable, after the formation of an imageand in the absence of all moistening, of accepting oily ink only in the image areas, and repulsing in the background areas, said plate comprising a support covered with an extern layer which is very abhesive and strongly bonded, non accepting ink in dry condition, constituting the non-imaged background areas, said layer having a value of sliding in interior dry condition of 40 g/cm.

DE-A-19,612,927 discloses a printing machine which comprises a printing cylinder and a covering layer, which surface or areas of said surface from a hydrophilic state in an non-hydrophilic state can be converted.

DD-103,977 comprises a method for providing lithographic plates wherein the necessary different moistening behaviour of the printing and non-printing areas are obtained by high energetic irradiation.

From the above it can be seen that a number of proposals have been made for making a driographic printing plate using a heat sensitive recording material. All these plates have the disadvantage that they have to be processed. In all cases there originates waste in the preparation of said plates. A printing plate prepared by a really wasteless process remains an unanswered wish of the printing industry.

SUMMARY OF THE INVENTION

According to the present invention it is an object to provide an alternative heat sensitive recording material for making a driographic printing plate of high quality requiring no processing whereby no waste whatsoever is produced.

It is a further object of the present invention to provide a method for obtaining a driographic printing plate of high quality using a heat sensitive recording material.

Further objects of the present invention will become clear from the description hereinafter.

According to the present invention there is provided a heat sensitive recording material comprising a support, thereon a surface layer comprising an ink abhesive binder and a compound capable of converting light to heat, characterized in that said binder is capable of being imagewise converted to an ink acceptive binder by exposure to heat or actinic irradiation.

According to the present invention there is also provided a method for making a lithographic printing plate requiring no dampening liquid comprising the step of:

preparing a heat sensitive recording material by coating on a support a surface layer comprising an ink abhesive polymer and a compound capable of converting light to heat, and image-wise exposing to heat or actinic irradiation said heat sensitive recording material thereby converting on the exposed areas said ink abhesive polymer into an ink accepting polymer.

DETAILED DESCRIPTION OF THE INVENTION

It has been found that the above described heat sensitive recording material yields printing plates without a developing process or without waste, what results in an economical and an ecological benefit.

In an embodiment of the present invention there is provided a heat sensitive recording material comprising a support, thereon a surface layer comprising an ink abhesive binder, preferably cured, and a compound capable of converting light to heat, characterized in that said binder is capable of being imagewise converted to an ink acceptive binder by exposure to heat or actinic irradiation.

In a preferred embodiment of the present invention there is provided a heat sensitive recording material consisting essentially of a support, thereon a surface layer essentially consisting of an ink abhesive binder, preferably cured, and a compound capable of converting light to heat, characterized in that said binder is capable of being imagewise converted to an ink acceptive binder by exposure to heat.

In another preferred embodiment of the present invention there is provided a heat sensitive recording material consisting essentially of a support, a compound capable of converting light to heat and a surface layer consisting essentially of an ink abhesive binder, preferably cured, characterized in that said binder is capable of being imagewise converted to an ink acceptive binder by exposure to heat or actinic irradiation.

In still another embodiment of the present invention there is provided a heat sensitive recording material comprising a support and a surface layer comprising a compound capable of converting light to heat and an ink abhesive binder, preferably cured, characterized in that said binder is capable of being imagewise converted to an ink acceptive binder by exposure to heat or actinic irradiation.

In still another preferred embodiment of the present invention there is provided a heat sensitive recording material consisting essentially of a support and a surface layer consisting essentially of a compound capable of converting light to heat and an ink abhesive binder, preferably cured, characterized in that said binder is capable of being imagewise converted to an ink acceptive binder by exposure to heat or actinic irradiation.

In the present invention the ink abhesive binder is preferably a silicon based polymer or a polymer containing perfluoralkyl groups, more preferably a cured silicon based polymer or a cured polymer containing perfluoralkyl groups. Said binder is made by coating on a support a non-cured ink abhesive polymer including reactive groups and a curing agent that is capable of curing said non-cured ink abhesive polymer by heating at a temperature between 100 and 150° C. during 5 minutes to 60 minutes. Preferably said non-cured ink abhesive polymer and said curing agent are coated from an aqueous dispersion.

Suitable aqueous silicone emulsions may be prepared from the following resins: VP 4350 which is a methyl silicone emulsion, VP 4302 which is a medium hard methyl-phenyl silicone resin and Dehesive 410E, all commercially available from Wacker Silicones of Adrian, Mich., U.S.A.; WSC 4009, SM2013 and SM30XX commercially available from General Electric of Waterford, N.Y., U.S.A.; and the PCXY silicone emulsions, commercially available from Rhone Poulenc of Louisville, Ky., U.S.A.

It will be appreciated that all the silicone emulsions described above are sold together with a suitable curing agent or agents.

According to the present invention the ink abhesive surface layer preferably contains a hardened silicone coating. Preferably the silicone coating is obtained by the reaction of at least two components one of which is generally a linear silicone polymer terminated with a chemically reactive group at both ends and a multifunctional component as a hardening agent. The silicone coating can be hardened by condensation curing or preferably by addition curing.

Condensation curing can be performed by using a hydroxy terminated polysiloxane that can be cured with a multifunctional silane. Suitable silanes are e.g. acetoxy silanes, alkoxy silanes and silanes containing oxime functional groups. Generally the condensation curing is carried out in the presence of one or more catalyst such as e.g. tin salts or titanates. Alternatively hydroxy terminated polysiloxanes can be cured with a polyhydrosiloxane polymer in the presence of a catalyst e.g. dibutyltindiacetate.

Addition curing is based on the addition of Si—H to a double bond in the presence of a platinum catalyst. Silicone coatings that can be cured according to the addition curing thus comprise a vinyl group containing polymer, a platinum catalyst e.g. chloroplatinic acid complexes and a polyhydrosiloxane e.g. polymethylhydrosiloxane. Suitable vinyl group containing polymers are e.g. vinyldimethyl terminated polydimethylsiloxanes and dimethylsiloxane/vinylmethyl siloxane copolymers.

Suitable dispersion of non-cured polymers containing perfluoralkyl groups are Bayguard, commercially sold by Bayer, Germany and Asahiguard, commercially sold by Asahi, Japan.

It will be appreciated that all the emulsions of non-cured polymers containing perfluoralkyl groups described above are sold together with a suitable curing agent or agents.

Other suitable dispersion of non-cured polymers containing perfluoralkyl groups are described by D. Schmidt, Nature, vol 368, 3 March 1994, p 39–41.

The non-cured polymers containing perfluoralkyl groups can be hardened by condensation curing or preferably by addition curing.

The thickness of the surface layer comprising an ink abhesive binder or a compound capable of converting light into heat and an ink abhesive, preferably cured binder lies between 1 and 10 μm, preferably between 2 and 5 μm.

Said surface layer comprising an ink abhesive preferably cured binder may comprise additional substances such as e.g. surfactants, plasticizers, pigments, dyes etc..

The heat sensitive recording material preferably includes a compound capable of converting light to heat. The compound capable of converting light into heat can be present in a layer underlying and contiguous to the recording layer but is preferably present in the recording layer. Suitable compounds capable of converting light into heat are more preferably infrared absorbing components although the wavelength of absorption is not of particular importance as long as the absorption of the compound used is in the wavelength range of the light source used for image-wise exposure. Particularly useful compounds are for example dyes and in particular infrared dyes, carbon black, metal carbides, borides, nitrides, carbonitrides, bronze-structured oxides and oxides structurally related to the bronze family but lacking the A component e.g. $WO_{2.9}$. It is also possible to use conductive polymer dispersions such as polypyrrole or polyaniline-based conductive polymer dispersions. It has been found that carbon black yields very good and favorable results.

The support of the heat sensitive recording material may be any support which is suitable for lithographic printing materials. Said support can be a layer having a hydrophilic or a hydrophobic surface such as a polymeric, a metallic or a glass layer.

The hydrophobic supports may be opaque or transparent, e.g. a paper support or a resin support. When a paper support is used preference is given to one coated at one or both sides with an alpha-olefin polymer, e.g. a polyethylene layer which optionally contains an anti-halation dye or pigment. Preferably an organic resin support is used e.g. cellulose esters such as cellulose acetate, cellulose propionate and cellulose butyrate; polyesters such as poly(ethylene terephthalate); polyvinyl acetals, polystyrene, polycarbonate; polyvinylchloride or poly-Alpha-olefins such as polyethylene or polypropylene.

One or more subbing layers may be coated between the support and the recording layer for use in accordance with the present invention in order to get an improved adhesion between these two layers.

In order to obtain a lithographic plate the heat sensitive element according to the invention is image-wise heated or, if containing a compound capable of converting light to heat, exposed to actinic irradiation and is then used as a printing plate without further development.

Heat is preferably applied by a thermal printer.

Actinic irradiation is light that is absorbed by the compound converting light into heat.

Image-wise exposure in connection with the present invention is preferably an image-wise scanning exposure involving the use of a laser or L.E.D.. It is highly preferred in connection with the present invention to use a laser emitting in the infrared (IR) and/or near-infrared, i.e. emitting in the wavelength range 700–1500 nm. Particularly preferred for use in connection with the present invention are laser diodes emitting in the near-infrared.

In heat sensitive recording materials according to any of the embodiments of the present invention the exposed areas become ink accepting. Without limiting our invention thereto, it is thought that by image-wise exposure to heat or actinic irradiation the surface of the ink abhesive layer undergoes a modification, but is not perforated as is proven by SEM recordings. The surface structure of the ink abhesive polymer is probably thorougly disturbed by the short temperature increase causing loss of the ink abhesive properties of said polymer.

The following examples illustrate the present invention without limiting it thereto. All parts are by weight unless otherwise specified.

EXAMPLE 1

An aqueous dispersion is prepared by mixing 40 g of a 15% carbon black dispersion in water, 24.35 g of a 50% silicone emulsion (Dehesive 410 E from Wacker-Chemie GmbH, Germany), 4.94 g of a 37% of a methyl hydrogen siloxane crosslinking agent (V 72 from Wacker-Chemie GmbH, Germany) and 10.00 g of a solution of a surfactant. This dispersion is made up with water to a final volume of 1000 g, coated on a subbed PET polyester support with a coating knife to a wet thickness of 250 μm and dried during 10 seconds at a temperature of 50° C. The plate was then thermally cured at 120° C. for 20 minutes. The dried layer thickness was 5 μm.

The plate was imaged on an external drum recorder equipped with a NdYLF laser source (1053 nm) delivering a power level of 150 to 450 mW in the plate plane, at a recording speed of 2 to 4 m/s.

Without any further treatment, the printing plate was then mounted on an ABDick 9860 printing press with a disengaged dampening system, and printed using a Hostman-Steinberg Reflecta Dry Magenta ink and with a non-compressible rubber blanket. Up to 100 copies of the image were satisfactorily printed.

Imaged and non-imaged areas were sputtered with gold before printing and then visualized by scanning electrode microscopy. From this microscopic analysis it is clear that the difference in thickness is less than 10% of the total layer thickness of the original layer.

EXAMPLE 2

A dispersion is prepared by mixing 12.5 g of WSC 4009 (trade name of General Electric Silicones, The Netherlands for a 27% solution of silicone compound) containing carbon black in toluene, 0.5 g of XC 89-A3399 (trade name of General Electric Silicones, The Netherlands for a 10% solution of cross-linker) in xylene, 6.25 g of XC9603 (trade name of General Electric Silicones, The Netherlands for a 14% solution of adhesion promoter) in ethanol and 0.9375 g of YC6831 (trade name of General Electric Silicones, The Netherlands for a 25% solution of catalyst) in toluene. This dispersion is coated on a subbed PET polyester support of 175 μm thickness and on grained and anodizes aluminum support of 0.15 mm with a coating knife to a wet thickness of 50 μm and dried during 10 seconds at a temperature of 50° C. The plate was then thermally cured at 150° C. for 1 minute. The dried layer thickness was 11.23 μm.

Each plate was imaged on an external drum recorder equipped with a NdYLF laser source (1053 nm) delivering a power level of 250 to 450 mW in the plate plane, at a recording speed of 2 to 8 m/s.

Without any further treatment, the printing plate was then mounted on an ABDick 9860 printing press with a disengaged dampening system, and printed using a Hostman-Steinberg Reflecta Dry Cyan ink and with a non-compressible rubber blanket. The ink acceptance of the exposed areas is very good.

EXAMPLE 3

An aqueous dispersion is prepared by mixing 33.30 g of a 15% carbon black dispersion in water, 60.00 g of a perfluorocarbon compound (Bayguard CA40181 from Bayer, Germany), 6.00 Crosslinker Bayguard CA40177 (from Bayer, Germany) and 10.00 g of surfactant. This dispersion is made up with water to a final volume of 1000 g, coated on a subbed PET polyester support with a coating knife to a wet thickness of 250 $\mu$m and dried during 10 seconds at a temperature of 50° C. The plate was then thermally cured at 120° C. for 20 minutes. The dried layer thickness was 5 $\mu$m.

The plate was imaged on an external drum recorder equipped with a Nd laser source (1053 nm) delivering a power level of 150 to 450 mW in the plate plane, at a drum speed of 2 to 4 m/s.

Without any further treatment, the printing plate was then mounted on an ABDick 9860 printing press with a disengaged dampening system, and printed using a Hostman-Steinberg Reflecta Dry Magenta ink and with a non-compressible rubber blanket. Up to 100 copies of the image were satisfactorily printed.

Imaged and non-imaged areas were sputtered with gold before printing and then visualized by scanning electrode microscopy. From this microscopic analysis it is clear that the difference in thickness is less than 10% of the total layer thickness of the original layer.

What is claimed is:

1. A heat sensitive recording material comprising a support, thereon a surface layer comprising an ink abhesive binder, a compound capable of converting light to heat, characterized in that said binder is imagewise converted to an ink acceptive binder by exposure to heat or actinic irradiation by modifying said binder.

2. A heat sensitive recording material according to claim 1 wherein said ink abhesive binder is a silicon based polymer or a polymer containing perfluoralkyl groups.

3. A heat sensitive recording material according to claim 2 wherein said ink abhesive binder is a cured silicon based polymer or a cured polymer containing perfluoralkyl groups.

4. A heat sensitive recording material according to claim 3 wherein said cured silicone based polymer is a silicone coating cured by addition curing.

5. A heat sensitive recording material according to claim 1 wherein the thickness of the surface layer lies between 1 and 10 $\mu$m.

6. A heat sensitive recording material according to claim 1 wherein said compounds capable of converting light into heat are infrared absorbing components.

7. A method for making a lithographic printing plate requiring no dampening liquid comprising the step of:

preparing a heat sensitive recording material by coating on a support a surface layer comprising an ink abhesive polymer and a compound capable of converting light into heat, and image-wise exposing to heat or actinic irradiation said heat sensitive recording material thereby converting on the exposed areas said ink abhesive polymer into an ink accepting polymer by modification of said polymer.

8. A method for making a lithographic printing plate requiring no dampening liquid comprising the step of:

preparing a heat sensitive recording material by coating on a support a surface layer comprising a non-cured ink abhesive polymer containing reactive groups, a curing agent for said ink abhesive polymer and curing said ink abhesive polymer thereby crosslinking the ink abhesive polymer, and a compound capable of converting light into heat, and image-wise exposing to heat or actinic irradiation said heat sensitive recording material thereby converting on the exposed areas said ink abhesive polymer into an ink accepting polymer by modification of said polymer.

9. A method for making a lithographic printing plate requiring no dampening liquid according to claim 8 wherein said image-wise exposing is carried out by an infrared laser.

* * * * *